US006540902B1

(12) United States Patent
Redey et al.

(10) Patent No.: US 6,540,902 B1
(45) Date of Patent: Apr. 1, 2003

(54) DIRECT ELECTROCHEMICAL REDUCTION OF METAL-OXIDES

(75) Inventors: Laszlo I. Redey, Downers Grove, IL (US); Karthick Gourishankar, Downers Grove, IL (US)

(73) Assignee: The United States of America as represented by the United States Department of Energy, Washington, DC (US)

( * ) Notice: Subject to any disclaimer, the term of this patent is extended or adjusted under 35 U.S.C. 154(b) by 11 days.

(21) Appl. No.: 09/945,721

(22) Filed: Sep. 5, 2001

(51) Int. Cl.[7] ..... C25C 3/00; C25C 3/36; C25C 3/34

(52) U.S. Cl. ..... 205/354; 205/363; 205/368

(58) Field of Search ..... 205/47, 336, 354, 205/367–372, 397, 406

(56) References Cited

U.S. PATENT DOCUMENTS 4,225,395 A * 9/1980 Tsang ..... 205/705
4,764,257 A * 8/1988 Sadoway ..... 205/336
4,888,102 A * 12/1989 Kessie ..... 204/230.1
4,995,948 A * 2/1991 Poa et al. ..... 205/47
5,015,343 A * 5/1991 LaCamera et al. ..... 205/354
5,427,657 A * 6/1995 Sharma ..... 205/560
5,976,345 A * 11/1999 Pal et al. ..... 205/336
6,299,742 B1 * 10/2001 Pal et al. ..... 204/243.1
6,440,279 B1 * 8/2002 De Capite et al. ..... 204/247.3

FOREIGN PATENT DOCUMENTS

WO 9964638 12/1999

* cited by examiner

*Primary Examiner*—Nam Nguyen
*Assistant Examiner*—Thomas H. Parsons
(74) *Attorney, Agent, or Firm*—Bradley W. Smith; Mark P. Dvorscak; Paul A. Gottlieb

(57) ABSTRACT

A method of controlling the direct electrolytic reduction of a metal oxide or mixtures of metal oxides to the corresponding metal or metals. A non-consumable anode and a cathode and a salt electrolyte with a first reference electrode near the non-consumable anode and a second reference electrode near the cathode are used. Oxygen gas is produced and removed from the cell. The anode potential is compared to the first reference electrode to prevent anode dissolution and gas evolution other than oxygen, and the cathode potential is compared to the second reference electrode to prevent production of reductant metal from ions in the electrolyte.

27 Claims, 5 Drawing Sheets

Sketch of the electrochemical cell used in the Direct Electrochemical Reduction of Metal-Oxides: Cell with metal-basket cathode.

Sketch of the electrochemical cell used in the Direct Electrochemical Reduction of Metal-Oxides: Cell with metal-basket cathode.

Sketch of the electrochemical cell used in the Direct Electrochemical Reduction of Metal-Oxides: Cell with metal-pan cathode.

DIRECT ELECTROCHEMICAL REDUCTION OF METAL-OXIDES

CONTRACTUAL ORIGIN OF THE INVENTION

The United States Government has rights in this invention pursuant to Contract No. DE-AC02-98CH10913 between the U.S. Department of Energy (DOE) and The University of Chicago representing Argonne National Laboratory.

BACKGROUND OF THE INVENTION

This invention relates to an electrochemical process and more particularly to an electrochemical cell in which metal-oxides can be reduced to their corresponding metals.

Electrochemical processes have been used to recover high purity metal or metals from an impure feed. Electrochemical processes have also been used to extract metals from their ores, e.g., metal-oxides. These processes typically rely on the dissolution of the metal or ore into the electrolyte and a subsequent electrolytic decomposition or selective electrotransport step. Thus they require an electrolyte in which the metal-oxide of interest is soluble. In addition, the decomposition voltage of the electrolyte should be larger than that of the metal-oxide.

In those cases where the metal-oxide has a very low solubility in the electrolyte, the reduction of the metal-oxide is typically a two-step process requiring two separate process vessels. For example in the extraction of uranium from spent nuclear oxide fuels, the first step is a chemical reduction step at 650° C. using lithium dissolved in molten LiCl that produces uranium and $Li_2O$. The $Li_2O$ dissolves in the molten LiCl. The second step is an electrowinning step, also at 650° C., wherein the dissolved $Li_2O$ in the molten LiCl is electrolytically decomposed to regenerate lithium. The resulting lithium and LiCl salt with a low $Li_2O$ concentration are then recycled to the reduction vessel for reduction of the next batch of oxide fuel. A number of engineering complexities are encountered in the design of the two-step process including the transfer of molten salt and lithium at high temperatures. It would also be advantageous to replace the two process vessels with one vessel to make the process more compact and economical.

In addition, the chemical reduction of oxides in molten salts is sometimes thermodynamically constrained. In these cases either the oxides cannot be reduced at all or they can be reduced only under certain limiting conditions. The first situation can be resolved by choosing the appropriate electrolyte-reductant system. For example, some of the rare-earth oxides cannot be reduced easily with the Li—LiCl system but can be reduced with a Ca—$CaCl_2$ system. The second situation is often encountered, for example in the reduction of $PuO_2$ in molten LiCl, the reduction can be carried out only if the $Li_2O$ concentration of the electrolyte, LiCl, is below 3.6 wt %. This limits the oxide loading of the electrolyte and as a result the oxide concentration of the electrolyte has to be carefully monitored and maintained at a low value to ensure complete reduction. This limits the amount of fuel that can be reduced in a given batch of fuel. Another consequence of limiting the oxide loading of the electrolyte is the need for more frequent transfers of molten electrolyte and liquid metal between the two process vessels.

Accordingly, it is an object of the invention to provide a process and an electrochemical cell for reducing metal-oxides to metals in a single-step using one process vessel with the ability to control the oxide concentration of the electrolyte at the desired level and to monitor the process. A significant feature of this invention is the applicability of the process for extracting a wide variety of metals by choosing an appropriate electrolyte.

SUMMARY OF THE INVENTION

Briefly, the invention is directed to an electrochemical cell for extracting metals wherein the cell includes a crucible to hold a molten electrolyte containing mobile oxide ions, a cathode consisting of a metal or ceramic basket or metal pan containing the metal-oxide or metal-oxides of interest, an anode (a non-consumable oxygen electrode), and one or more reference electrodes monitoring the electrode potentials. The anode and cathode are connected to an external power supply. Some of the advantages of the inventive process and cell are (1) it is a one-step, one-vessel process which eliminates engineering complexities associated with handling and transfer of molten salts and metals and reduces the number of components associated with a two-step process, (2) a very low level of dissolved oxide-ion concentration can be maintained in the electrolyte making it easy to reduce oxides like $PuO_2$ and $AmO_2$, (3) there is no formation of free-floating or excess reductant metal in the cell, (4) excellent process control through the use of reference electrodes, (5) semi-continuous process; only periodic exchange of basket or pan required, (6) environmentally friendly with oxygen being the only byproduct, (7) high-purity metals can be produced even with a starting mixture of impure metal-oxides, (8) potential to greatly reduce capital expenditure and manufacturing costs, e.g., in the processing of spent nuclear fuels since the hot-cell space requirements will be significantly reduced, and (9) it is a very versatile process and can be adapted for the extraction of a variety of metals by choosing an appropriate electrolyte.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

The present invention together with the above and other objects and advantages may best be understood from the following detailed description of the embodiment of the invention illustrated in the drawings, wherein.

DETAILED DESCRIPTION OF THE PREFERRED EMBODIMENT

Figure 1:
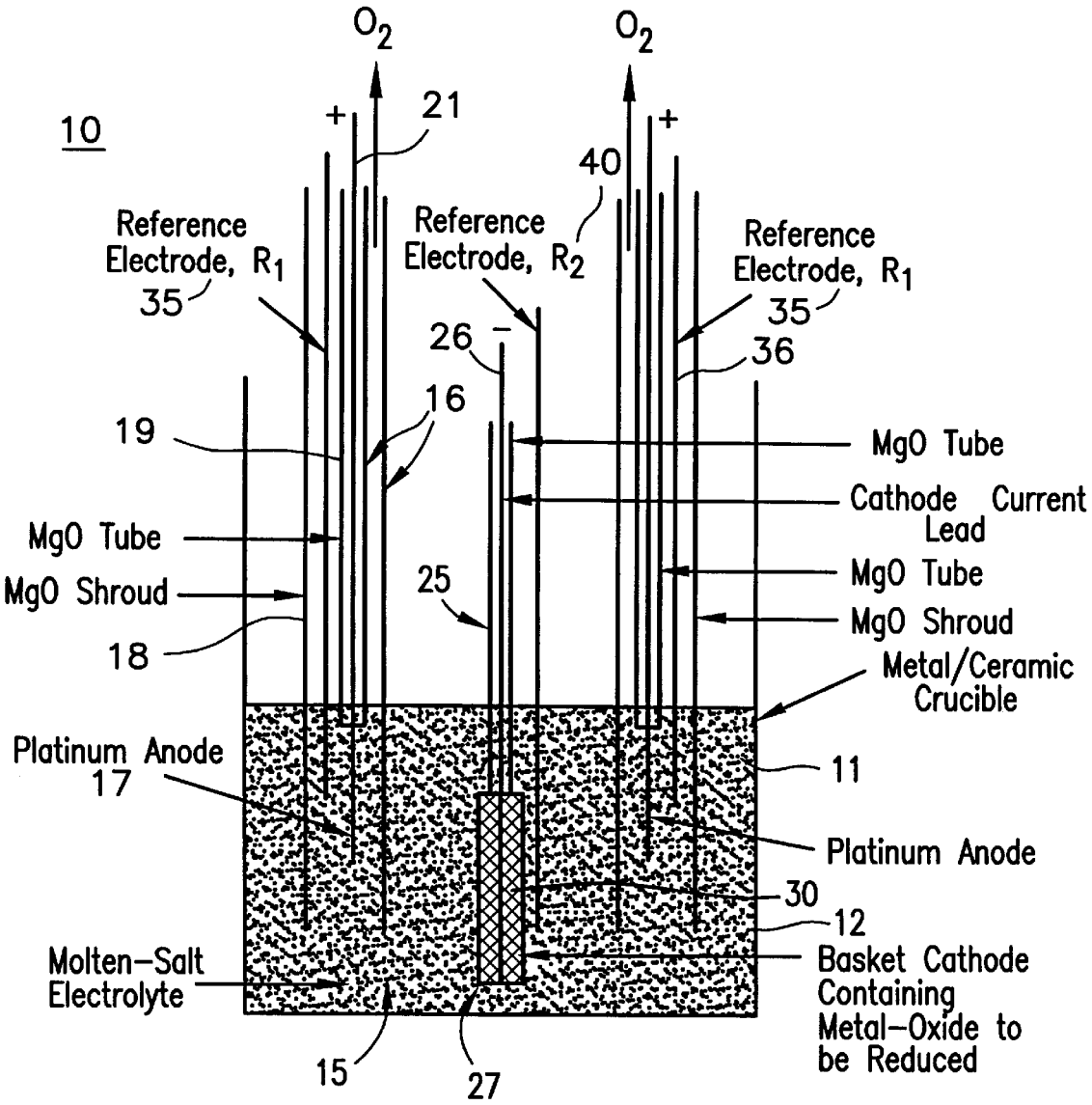
FIG. 1 is a schematic of an electrochemical cell containing a metal-basket oxide holder as one embodiment of the invention.

As illustrated in FIG. 1, the cell 10 includes a ceramic crucible 11 (or metallic crucible electrically isolated from the cathode), preferably a high-density MgO crucible. A secondary crucible 12 made of stainless steel surrounds the primary crucible. The electrolyte 15 is an appropriate halide salt or mixture of halide salts containing a soluble oxide, e.g., LiCl—$Li_2O$ or $CaCl_2$—CaO. Fluoride salts can also be used. The choice of the electrolyte depends on the metal-oxide being reduced. For example $CaCl_2$—CaO or $CuF_2$—$CuCl_2$—CuO, or some other suitable Ca-based electrolyte is preferred for the reduction of rare-earth oxides. In addition, the process temperature is dependent on the melting point of the electrolyte. As a result, the process temperature is about 200° C. higher for a $CaCl_2$—CaO electrolyte compared to a LiCl—$Li_20$ electrolyte. To lower the process temperature mixtures of halide salts such as low-melting eutectic LiCl—$CaCl_2$ containing soluble oxide ions may be used as the electrolyte. The presence of dissolved species of the metal of interest is not a requirement for this process. However, the electrolyte 15 should contain mobile oxide ions. The concentrations of the dissolved oxide species are controlled during the process by controlled additions of soluble oxides or chlorides by electrochemical or other means.

The anode assembly 16 may include a platinum or $SnO_2$ anode 17 or any other suitable non-consumable oxygen electrode. These non-consumable oxygen electrodes, also referred to as dimensionally-stable anodes 17, are chemically and dimensionally stable in the electrolyte environment of interest. An anode current lead 21 is inside a close fitting tube 19 of a dense ceramic such as MgO.

Figure 3:
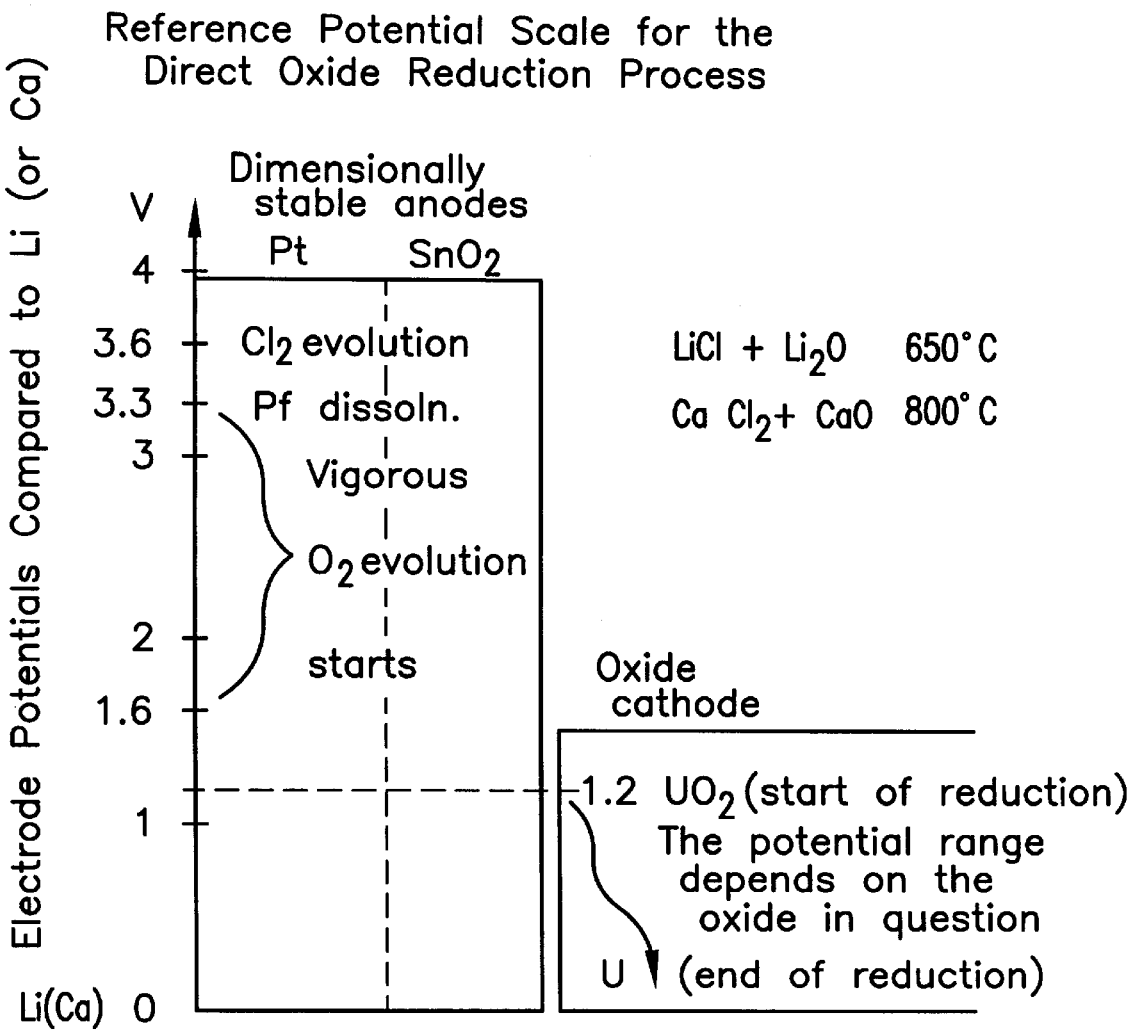
FIG. 3 is a graphical representation of the relationship between electrode potential and gas evolution and metal reduction.

Further, in certain situations it may be necessary to exchange one anode for another during the reduction process. For example, when the oxide mixture consists of $UO_2$ and rare-earth oxides, the $UO_2$ can be reduced at relatively high dissolved oxide concentrations. However, the rare-earth oxide reduction, as described earlier, is thermodynamically constrained and requires low dissolved oxide concentrations in the electrolyte. Further at low dissolved oxide concentrations, it is likely that there will be co-evolution of chlorine along with oxygen at the anode. As a result, during this phase of the reduction it is necessary to work with anode materials that are stable in a chlorine gas environment as well as an oxygen gas environment. Examples of such anode materials include tin oxide and carbon/graphite. However, carbon/graphite is only a secondary choice at higher oxide concentrations because it is not stable, chemically and dimensionally, when oxygen gas is evolved vigorously. Thus, it may be necessary to implement a two-anode process, where initially an oxygen-stable anode such as Pt, $SuO_2$, $LiFeO_2$ or some other suitable mixed oxide ($Li_xFe_yNi_{(1-y)}O_z$) is used at relatively high dissolved oxide concentrations and subsequently to continue the reduction, a chlorine-stable anode such as $SnO_2$ or carbon/graphite is introduced in place of the oxygen-stable anode and the reduction reaction continued at lower dissolved oxide concentrations in the electrolyte. Reference to FIG. 3 shows the relationship between electrode potential and gas composition evolved. As seen, oxygen evolution occurs above 1.6 volts and by 3.6 volts chlorine gas is evolved.

In addition to the anode 17 and anode current lead 21, the anode assembly 16 also consists of MgO shroud 18 around the anode and a reference electrode 35(R), which may be positioned inside the MgO shroud 18. A MgO shroud 18 is used to provide a suitable venting system for the evolved oxygen at the anode, thereby preventing the diffusion of oxygen to other cell locations where it could result in corrosion of cell components or a lowering of the cell efficiency by recombining with the reduced metal. An exhaust system, not shown, removes oxygen from the shroud 18. Multiple anode assemblies 16 can be used as shown in FIG. 1. The oxygen venting system is further designed to measure the net rate of oxygen exhausted from the cell as well as the total volume of oxygen produced. Since the net rate of oxygen exhausted from the cell depends on the current efficiency of the process, the instantaneous current efficiency can be calculated from the continuous monitoring of the net rate of oxygen exhausted from the cell and the current passed through the cell as well as the total volume of oxygen produced. Further, integration of the net rate of oxygen over a given time period will yield the total quantity of oxygen exhausted from the cell which can be used to calculate the extent of metal oxide reduction in the given time period.

The cathode assembly 25 consists of two components—a current lead 26 made of an inert metal such as stainless steel, Ta and a bed 30 of metal-oxide of interest. By inert metal we mean inert to the system environment. The lower portion of the current lead 26 is shaped into a stainless or porous ceramic, i.e. MgO, basket 27 (FIG. 1) or pan 28 (FIG. 2) to hold the metal-oxide of interest. To enhance conductivity, the oxide particles in the bed 30 may be premixed with metal particles, metal product formed in prior reduction runs or consist of oxide fuel encased in metal cladding as in spent nuclear fuel rod segments. The basket 27 containing the metal oxide of interest is termed a fuel basket. The fuel basket 27 can be constructed of any suitable screen material to allow transport of electrolyte 15 to the fuel basket 27 interior. For example, for the reduction of $UO_2$; particle size >45 $\mu$m, the fuel basket 27 can be constructed of a 100-mesh stainless steel screen material with a 325-mesh stainless steel lining on the inside. Different particle sizes will require different screen material, as is well known in the art.

Reference electrodes 35, 40 are used to monitor the electrode potentials. The construction of the reference electrodes 35, 40 depends on the electrolyte being used. For example, for the LiCl—$Li_2O$ electrolyte system, the reference electrode 35, 40 may consist of pure lithium, or a suitable Li-alloy such as Sn—Li, or Ni/NiO, $Fe/Fe_3O_4$ in contact with the electrolyte. The metal or alloy, or oxide reference electrode 35, 40 is contained in a high-density MgO tube 36. A porous plug (not shown) at the end of the MgO tube provides the connectivity between the reference electrode and the electrolyte. In the reduction of $PuO_2$ or $Nd_2O_3$, in a $CuCl_2$—CaO electrolyte, the reference electrode may be Ca or a Ca alloy, or Ni/NO, $Fe/Fe_2O_3$ or other suitable stable electrode material.

The current leads of the anode, the cathode, and the reference electrodes are electrically insulated from one another through the use of high-density MgO tubes around the electrodes. The MgO tubes around the electrodes are also used to prevent oxygen-induced corrosion in the melt and gas phases. The cell 10 can be configured to include a stirrer in the electrolyte (not shown) to enhance mass transport of the dissolved oxide species. In addition, vibration of the oxide bed 30 in the cathode basket 27 or pan 28 can improve the cathode process rate. The cathode and anode are connected to external power sources as is well known in the art. Real-time data can be recorded using a data acquisition system and a computer. The data recorded includes the cell voltage (anode vs. cathode), the cell current, the potential of the anode vs the reference electrode, the potential of the cathode vs. the other reference electrode, and the power source voltage.

In the operation of the cell 10, a current-controlled electrochemical process is carried out in such a way that a desired electrochemically generated reducing potential is established at the cathode at a suitable temperature where the salt is molten. Depending on electrolyte composition, the temperature may range from about 400° C. to about 1200° C. Under the force of the reducing potential, the oxygen from the metal-oxide, MO, in the cathode (fuel basket) dissolves into the electrolyte as an oxide ion leaving the metal, M, behind in the fuel basket as follows:

Cathode reaction: $MO+2e^- \rightarrow M+O^{2-}$

The current source provides the reductant electrons. At the anode, the oxide ion is converted to oxygen gas.

Anode reaction: $O^{2-} \rightarrow \frac{1}{2}O_2+2e^-$

In the presence of $Li^+$ ions, the two reactions above are formally equivalent to the following reaction sequence:

$$MO+2e^-+2Li^+ \rightarrow MO+2Li \rightarrow M+Li_2O$$

However, this reaction sequence may not take place if the cathode is maintained at a less negative potential than the one at which lithium deposition will occur. Intermediate electrode reactions are also likely. Examples of these reactions are given below.

$$MO+xe'+xLi^+ \rightarrow Li_xMO$$

$$Li_xMO+(2-x)e+(2-x)Li^+ \rightarrow M+2Li^++O^{2-}$$

The resulting incorporation of lithium into the metal-oxide crystal structure could enhance the conductivity of the metal-oxide, thereby causing a catalytic effect favoring the reduction process.

In summary, the inventive process relies on an electrochemically generated reducing potential at the cathode to reduce the metal-oxide and does not depend on either the generation of a reductant metal such as lithium or the presence of the soluble species of the metal being produced to accomplish the reduction. In fact, the metal-oxide of interest should only be sparingly soluble or preferably insoluble in the molten electrolyte.

In this process, unwanted side reactions at the cathode or anode are prevented by the use of one or more reference electrodes to control the electrode potentials. The openings of the reference electrodes (Luggin capillary) are placed close to the cathode surface as is well known for the use of reference electrodes. The electrode potentials are maintained at the desired levels by controlling the cell current with the help of a feedback loop between the reference electrodes and the current source. Unwanted anode reactions may include chlorine evolution if the potential is too high, see FIG. 3, while unwanted cathode reactions may include the production of free-floating droplets of reductant metal such as lithium or calcium. Both these reactions will result in the destruction of the platinum anode. However, a $SnO_2$ anode will not be affected by chlorine evolution.

The transport of the dissolved oxide-ion species, e.g. $Li_2O$ in molten LiCl, in the molten electrolyte may impact the production rate in this process. Hence, the cell should be configured to include a stirrer, if required, to enhance diffusional transport of the dissolved oxide-ion species. In addition, vibration of the oxide bed as stated above in the cathode basket 27 or pan 28 can improve the cathode process rate. However, evolved oxygen could attack the cell walls, components or recombine with the produced metal so the shroud 18 is used around each anode to retain and transport oxygen out of the cell, which is operated in an inert atmosphere such as helium or argon or any atmosphere suitable to exclude $N_2$, $O_2$ or moisture from the cell.

EXAMPLE I

Direct Electrochemical Reduction of $UO_2$

The electrochemical reduction was performed at 650° C. in a helium atmosphere glove box using 20 g of $UO_2$ as the fuel and LiCl-1.3 wt % $Li_2O$ as the electrolyte. Crushed $UO_2$ pieces, varying in size between 0.5 and 1.0 cm, were used in the experiment. The primary and secondary crucibles were made of high-density MgO and stainless steel, respectively. The anode was a platinum wire, 1.5 mm in diameter. The platinum wire, except for a 1" segment that was exposed to the electrolyte, was insulated with a high-density MgO tube. The lower portion of the cathode current lead was shaped into a fuel basket to contain the $UO_2$ fuel. The fuel basket was constructed from 100-mesh stainless steel screen material. Reference electrodes were used to monitor the anode and cathode potentials.

The reference electrode consisted of a Ni electrode lead wire in contact with a mixture of NiO and fine Ni powder. The reference electrode was contained in a high-density MgO tube. A porous plug at the end of the MgO tube provided the connectivity between the reference electrode and the electrolyte.

The reduction was performed under current-controlled conditions using the reference electrode to ensure that the anode potential did not approach the chlorine evolution potential. The cell was operated for 12 hours. The reduction product at the end of the run was black and showed no visible signs of lithium. X-Ray Diffraction (XRD) results confirmed that the reduction product was uranium metal. There were no peaks of $UO_2$ in the XRD pattern. Based on visual observations and XRD analysis, the reduction was estimated to be at least 90% complete. There were no visible signs of lithium on the fuel basket or in the salt phase. The $Li_2O$ concentration of the salt was measured to be 1.2 wt %, a marginal decrease from the starting value. The Pt-anode showed a dark external layer but no evidence of corrosion or embrittlement.

EXAMPLE II

Direct Electrochemical Reduction of $Nd_2O_3$

Figure 2:
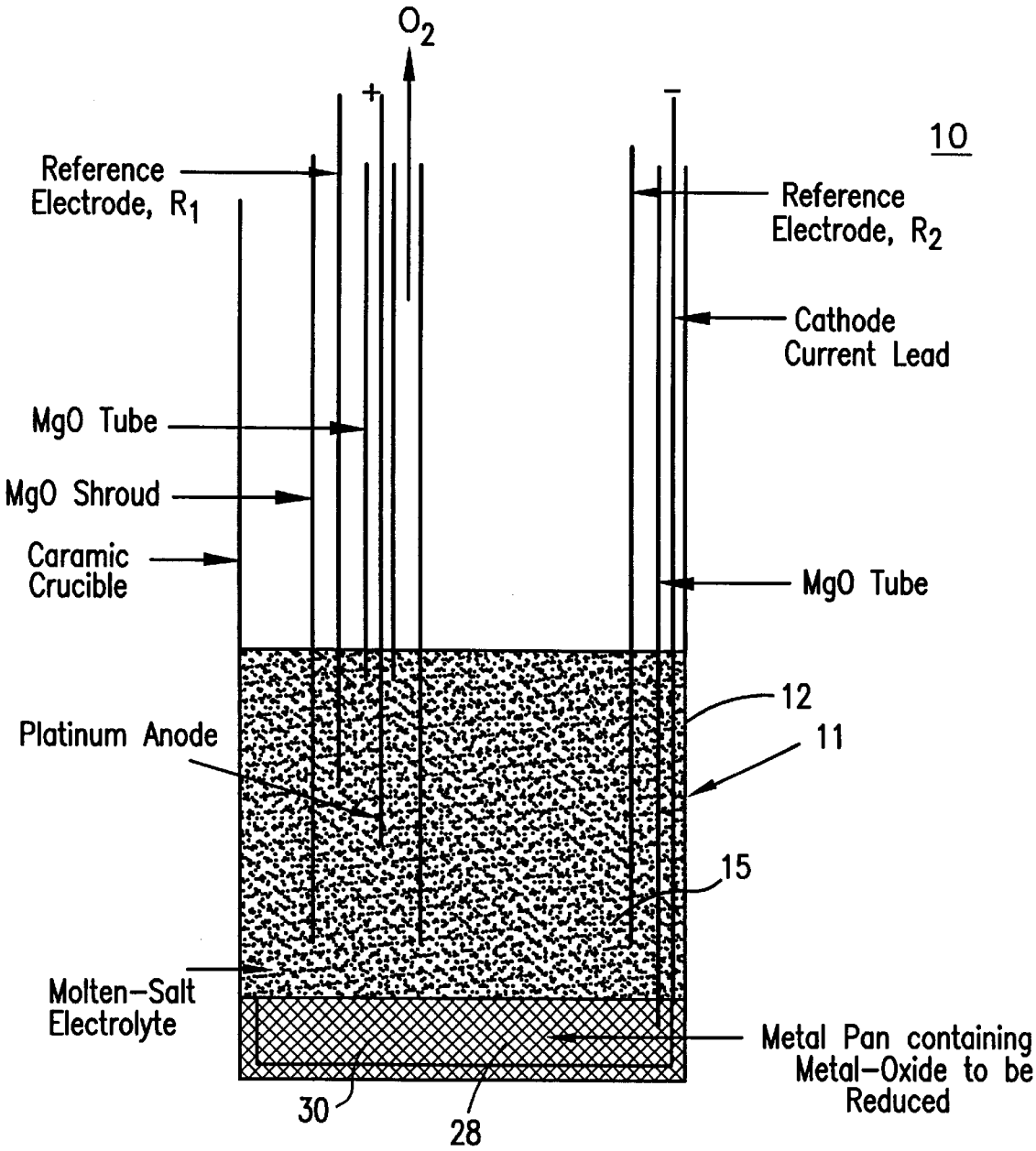
FIG. 2 is a schematic of an electrochemical cell containing a metal-pan oxide holder as another embodiment of the invention.

The electrochemical reduction was performed at 800° C. in a helium atmosphere glove box using 2.58 g of $Nd_2O_3$ in a $CaCl_2$-0.4 wt % CaO electrolyte. A mixture of fine powder and sintered pieces (0.2–0.5 cm size) of $Nd_2O_3$ was placed in a tantalum pan cathode located at the bottom of a high-density MgO crucible (FIG. 2). The anode was a platinum wire, 1.5 mm in diameter. The platinum wire, except for a 1" segment that was exposed to the electrolyte, was insulated with a high-density MgO tube. A Ni/NiO reference electrode was used to monitor the anode and cathode potentials. The reference electrode consisted of a Ni wire in contact with a mixture of fine powders of NiO and Ni. The reference electrode was contained in a high-density MgO tube. A porous plug at the end of the MgO tube provided the connectivity between the, reference electrode and the electrolyte.

The reduction was performed under current-controlled conditions using the reference electrode to ensure that the anode potential did not approach the chlorine evolution potential. The cell was operated for 16 hours. The reduction product at the end of the run consisted of a shiny metallic layer at the bottom of the cell and above the layer of gray particles finely distributed in the electrolyte. XRD analysis of the gray layer indicated NdOCl. Chemical analysis of the metallic layer indicated neodymium metal in the reduction product.

By intermittently checking the appropriate reference electrode-anode potential or reference electrode-cathode potential, harmful side reactions may be prevented, i.e.

chlorine production at the anode or reductant metal production at the cathode, such as lithium or calcium. Generally, the dissolved oxide concentration (such as $Li_2O$) is maintained substantially constant throughout the cell operation, such as at 0.5–1 weight percent. However, at the end of cell operation, the operating conditions may vary substantially as the dissolved oxide concentration may be driven toward zero. Under these conditions, the anode material may be changed from an oxygen-stable anode of Pt (as an example) to a chlorine-stable anode, such as $SnO_2$ or graphite. The $SnO_2$ anode is stable for both oxygen and chlorine evolution.

The dissolved oxide concentration can be monitored by intermittently analyzing melt samples of the electrolyte or using a $Li_2O$-saturated Ni/NiO reference electrode for the LiCl system or a CaO-saturated Ni/NiO reference electrode for the $CaCl_2$ system. Generally, for $UO_2$ reduction in the LiCl system, the dissolved oxide ($Li_2O$) concentration is maintained in the 0.5–1 weight percent range. Dissolved oxide concentrations will differ for different oxide reductions and electrolytes. As understood, in order to reduce some rare earth oxides, the dissolved oxide concentration may be lower, for instance less than about 0.05 wt. %.

Figure 4:
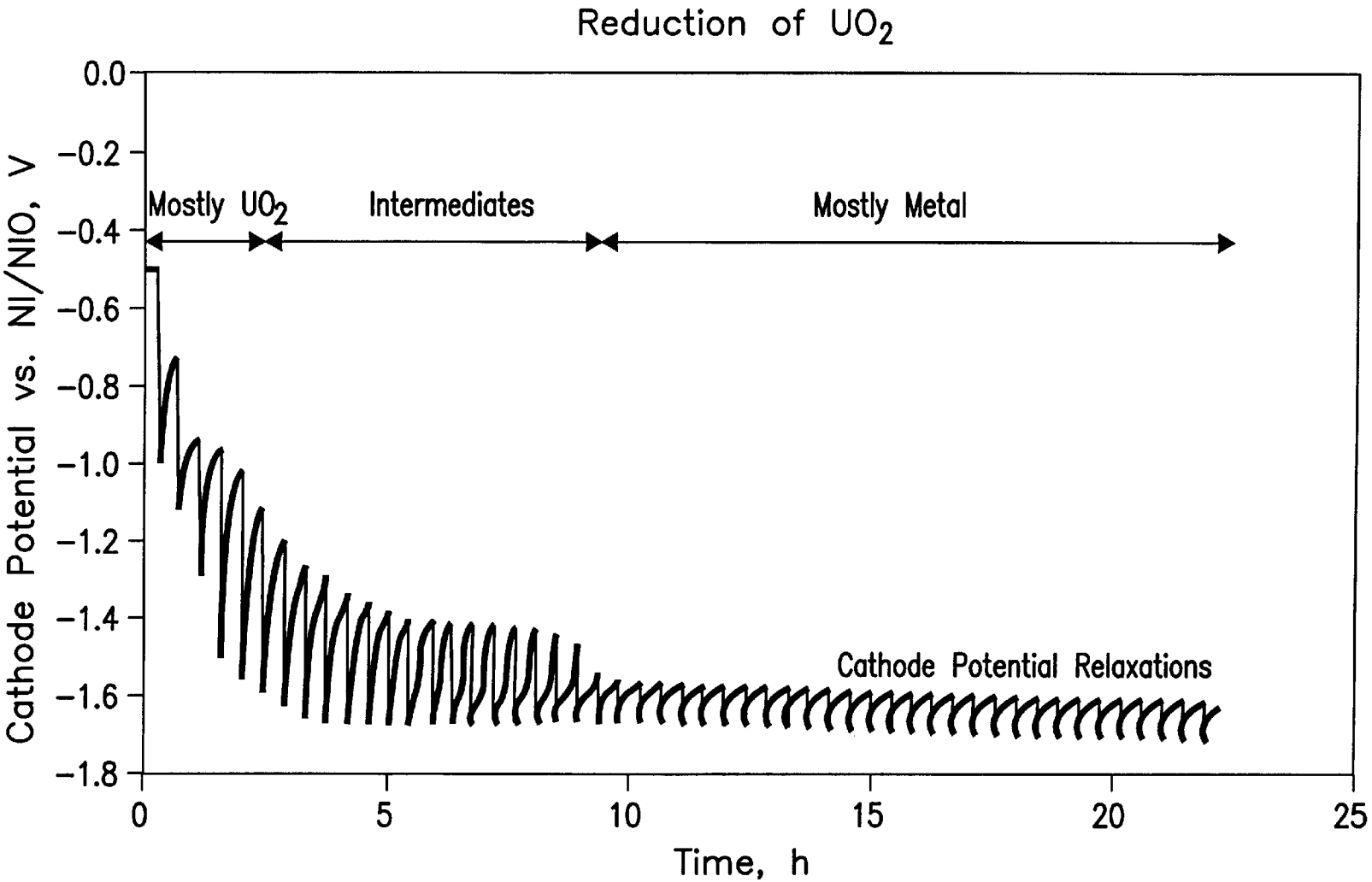
FIG. 4 shows cathode potential relaxations for the process of $UO_2$ reduction in LiCl melt. The cathode potential relaxations indicate composition of the cathode bed. Three characteristic ranges of the compositions are marked.
Figure 5:
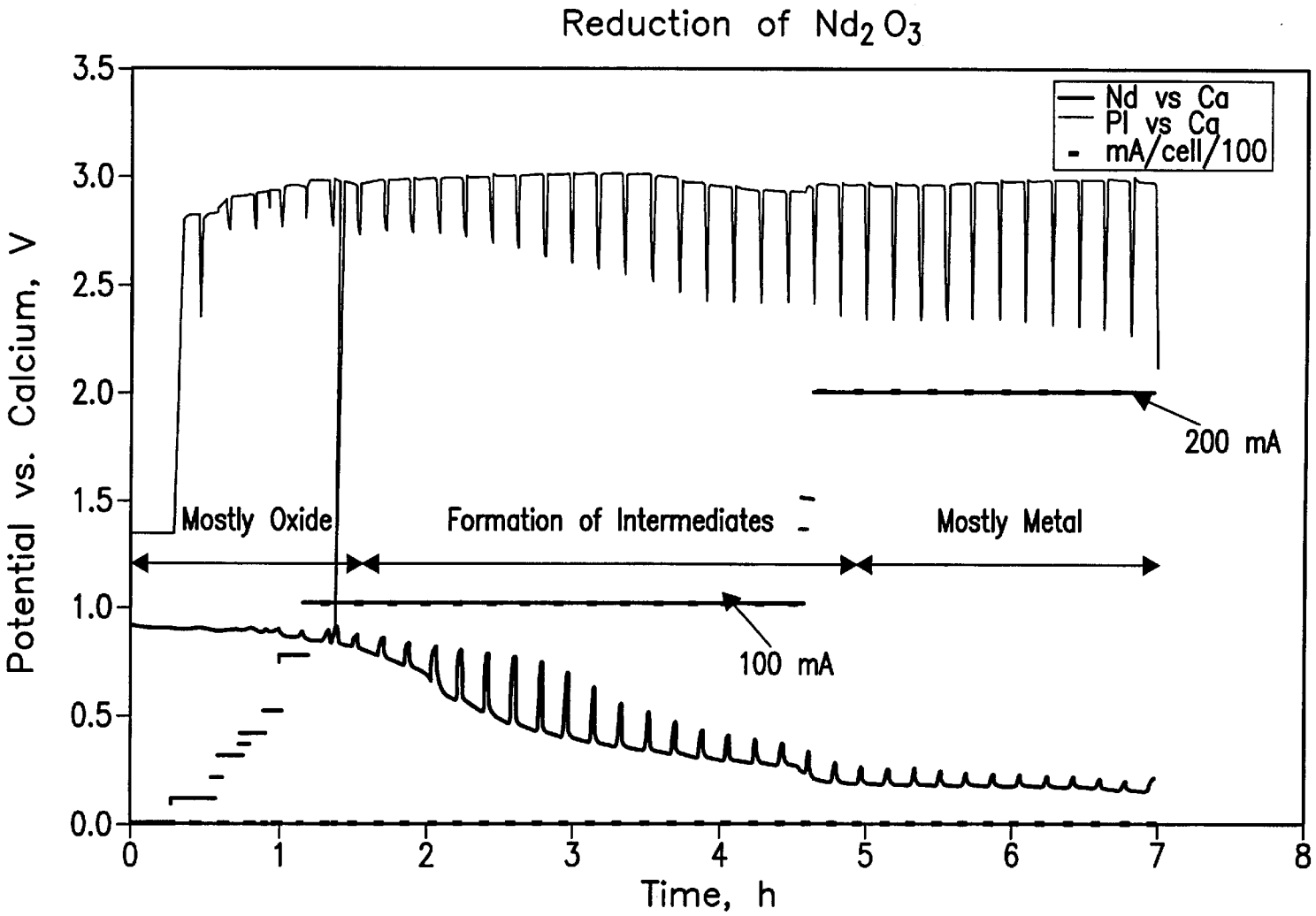
FIG. 5 shows cathode and anode potential relaxations for the process of $Nd_2O_3$ reduction in $CaCl_2$ melt. The cathode potential relaxations indicate composition of the cathode bed. Three characteristic ranges of the compositions are marked.

Another aspect of the invention is using potential relaxation on open circuit by current interruption to determine product composition, that is whether only oxide is in the cathode or only metal or mixed oxide and metal. For instance, FIGS. 4 and 5 show different relaxation curves indicating (a) all oxide, (b) all metal or (c) mixed metal and oxide.

While there has been disclosed what is considered to be the preferred embodiment of the present intention, it is understood that various changes in the details may be made without departing from the spirit, or sacrificing any of the advantages of the present invention.

The embodiments of the invention in which an exclusive property or privileges is claimed are defined as follows:

1. A method of controlling the direct electrolytic reduction of a metal oxide or mixtures of metal oxides to the corresponding metal or metals comprising establishing a non-consumable anode and a cathode in contact with a molten salt electrolyte having mobile oxygen ions and reductant metal ions, providing a first reference electrode near the non-consumable anode and a second reference electrode near the cathode, establishing a substantially constant voltage across the anode and cathode or passing a substantially constant current between the anode and the cathode to reduce the metal oxide or oxide mixtures to the corresponding metal or metals while producing oxygen gas, and monitoring the anode potential compared to the first reference electrode to prevent anode dissolution and gas evolution other than oxygen, and monitoring the cathode potential compared to the second reference electrode to prevent production of reductant metal from ions in the electrolyte.

2. The method of claim 1, wherein the anode is selected from the group consisting of Pt, $SnO_2$, $LiFeO_2$ and $Li_xFe_y Ni_{(1-y)}O_z$.

3. The method of claim 1, wherein the reference electrode is selected from the group consisting of $Li/Li_2O$, Ni/NiO, and $Fe/Fe_3O_4$.

4. The method of claim 1, wherein the cathode consists of two components.

5. The method of claim 4, wherein the cathode includes a current lead of stainless steel or Ta and a bed of the metal oxide to be reduced in a container of stainless steel or Ta or a porous ceramic.

6. The method of claim 1, wherein the anode includes an oxygen venting system.

7. The method of claim 6, wherein the oxygen venting system includes a ceramic shroud for collecting oxygen produced at the anode.

8. The method of claim 7, wherein the oxygen collected in the shroud is removed from the anode.

9. The method of claim 1, wherein reduction is of a metal oxide or metal oxide mixtures with a lithium chloride containing electrolyte maintained at a temperature of from about 400° C. to about 700° C. having $Li_2O$ dissolved therein.

10. The method of claim 1, wherein reduction is of a rare earth oxide or oxides with a calcium chloride containing electrolyte maintained at a temperature of about 600° C.–1100° C. and having CaO dissolved therein.

11. The method of claim 1, wherein a mobile oxygen ion concentration is maintained substantially constant in the electrolyte during the reduction of the metal oxide.

12. The method of claim 11, wherein the metal is U or alloys thereof.

13. The method of claim 11, wherein the metal is Nd or its alloys.

14. The method of claim 11, wherein the metal oxide is an actinide oxide.

15. The method of claim 11, wherein the metal oxide is a rare earth oxide.

16. The method of claim 11, wherein the metal oxide is one or more of Ca oxide, lithium oxide, vanadium oxide, titanium oxide, tantalum oxide and tungsten oxide.

17. The method of claim 1, wherein the metal oxide is substantially insoluble in the molten salt electrolyte.

18. The method of claim 1, wherein the electrolyte is one or more of $LiCl_2$, $CaCl_2$, LiCl—$CaCl_2$, LiCl—KCl and the alkali or alkaline earth metal fluorides.

19. The method of claim 1, wherein a cathode assembly includes a basket of predetermined size and shape.

20. The method of claim 1, wherein the total quantity of oxygen evolved is determined and used to calculate the extent of metal oxide reduction.

21. The method of claim 1, wherein the cathode is vibrated during reduction.

22. The method of claim 1, wherein the electrolyte is agitated during reduction.

23. A method of electrochemically reducing metal oxide comprising establishing a molten chloride or fluoride electrolyte having mobile oxide ions and reductant metal ions therein under an inert atmosphere, positioning an oxygen stable anode assembly surrounded by a shroud of substantially oxygen impervious material and a first reference electrode in the molten electrolyte, positioning a cathode assembly including a porous container for the metal oxide and a second reference electrode in the molten electrolyte, establishing a substantially constant potential across the anode assembly and the cathode assembly or passing a substantially constant current between the anode assembly and the cathode assembly to reduce metal oxide or oxide to metal or metals at the cathode while producing oxygen gas at the anode, periodically interrupting the electrolytic process to determine the anode potential relaxation with respect to the first reference electrode and to determine the cathode potential relaxation with respect to the second electrode and adjusting the potential across the anode assembly and the cathode assembly or the current to prevent anode dissolution or production of reductant metal from its ions in the electrolyte and to maintain the reductant metal production such that the reductant metal is being consumed in a chemical reaction with the oxide to be reduced at about the same overall rate as the reductant metal is being produced.

24. The method of claim 23, wherein a chlorine stable anode assembly is substituted for the oxygen stable anode assembly when the concentration of oxide ions is reduced toward zero.

25. The method of claim 23, wherein a shroud extends out of the electrolyte to contain oxygen gas produced at the anode and prevents oxygen from recombining with the metal produced at the cathode, and prevents corrosion of cell components, and prevents contamination of the inert gas atmosphere of the cell components.

26. The method of claim 25, wherein the shroud is high density MgO or $Al_2O_3$.

27. The method of claim 23, wherein two or more anode assemblies are operated in conjunction with one or more cathode assemblies.

* * * * *